US010578387B2

(12) United States Patent
Ostanin

(10) Patent No.: US 10,578,387 B2
(45) Date of Patent: Mar. 3, 2020

(54) TRIGGER MECHANISM FOR A REPEATING RIFLE

(71) Applicant: Steel-Action GmbH, Köln (DE)

(72) Inventor: Alexander Ostanin, Suhl (DE)

(73) Assignee: Steel-Action GmbH (DE)

( * ) Notice: Subject to any disclaimer, the term of this patent is extended or adjusted under 35 U.S.C. 154(b) by 0 days.

(21) Appl. No.: 16/119,699

(22) Filed: Aug. 31, 2018

(65) Prior Publication Data

US 2019/0072350 A1 Mar. 7, 2019

(30) Foreign Application Priority Data

Sep. 4, 2017 (DE) ..... 10 2017 120 307

(51) Int. Cl.
*F41A 19/16* (2006.01)
*F41A 19/32* (2006.01)

(52) U.S. Cl.
CPC ..... *F41A 19/16* (2013.01); *F41A 19/32* (2013.01)

(58) Field of Classification Search
CPC ..... F41A 19/10; F41A 19/12; F41A 19/17
USPC ..... 42/69.01, 69.02
See application file for complete search history.

(56) References Cited

U.S. PATENT DOCUMENTS 2,126,076 A * 8/1938 Wright ..... F41A 19/16 42/69.02
2,341,299 A * 2/1944 Sweany ..... F41A 19/16 42/69.01
4,016,668 A * 4/1977 Frazier ..... F41A 19/16 42/69.01
4,058,924 A * 11/1977 Mullner ..... F41A 19/17 42/69.01
4,095,363 A * 6/1978 Riedl ..... F41A 3/10 42/23
6,553,706 B1 * 4/2003 Gancarz ..... F41A 17/46 42/69.02
9,170,063 B2 * 10/2015 Krieger ..... F41A 19/10
9,671,186 B1 * 6/2017 Hoekema ..... F41A 19/17
10,132,586 B1 * 11/2018 Hoekema ..... F41A 19/29
2011/0277367 A1 * 11/2011 Krieger ..... F41A 19/10 42/69.01
2012/0227301 A1 * 9/2012 Simmons ..... F41A 19/10 42/69.01

FOREIGN PATENT DOCUMENTS

DE 102010051641 B3 4/2012

* cited by examiner

*Primary Examiner* — John Cooper
(74) *Attorney, Agent, or Firm* — Maine Cernota & Rardin

(57) ABSTRACT

A trigger mechanism for a repeating rifle includes a sear pivotable about a first axis, a detent lever pivotable about a second axis and having an extension with a catch that is engaged with the sear when the mechanism is cocked, and a trigger pivotable about a trigger axis, wherein upon rotational actuation thereof, the trigger acts directly upon the detent lever, without any intervening components, pivoting the detent lever about the second axis in a direction opposite to the trigger rotation, and releasing the sear projection from the detent lever catch. In embodiments, the trigger pull is adjusted by an adjusting spring driven by an adjusting screw that is freely accessible from beneath the trigger mechanism. Embodiments further include a sear return spring between the sear and detent lever, and/or a trigger return spring opposing the adjusting spring that holds the trigger in a defined position without play.

14 Claims, 3 Drawing Sheets

TRIGGER MECHANISM FOR A REPEATING RIFLE

RELATED APPLICATIONS

This application claims the priority of German patent application No. DE102017120307.9, filed Sep. 4, 2017, which is herein incorporated by reference in its entirety for all purposes.

FIELD OF THE INVENTION

The present invention pertains to firearms, and more particularly to trigger mechanism for repeating rifles.

BACKGROUND OF THE INVENTION

DE 10 2010 051 641 B3 discloses a trigger mechanism for a repeating rifle wherein the mechanism additionally comprises a pin-shaped connecting element that is acted upon by an upwardly protruding extension of the trigger. The catch of the detent lever is engaged with a counter-catch that is arranged on a stationary detent element approximately at the height of the pin-shaped connecting element. In this known solution, the catch mechanism in the cocked position is therefore formed between the detent lever and the counter-catch. When the trigger is actuated, the detent lever is initially acted upon by the pin-shaped connecting element and then pivots in the same rotating direction as the sear after the disengagement of the catch mechanism, wherein the detent lever tilts forward and releases the firing pin.

A disadvantage of this known trigger mechanism can be seen in that due to the poor accessibility of the adjusting mechanism, an adjustment of the trigger pull can only be carried out after the weapon has been disassembled, i.e. typically only by a gunsmith, but not by the user of the weapon himself.

U.S. Pat. No. 2,341,299 A describes a trigger mechanism in which the detent lever is not directly acted upon by the trigger, but rather by an interposed rod, which extends from the upper end of the trigger to the rear side of the detent lever, such that the detent lever is indirectly acted upon by this rod when the trigger is actuated. In this case, the detent lever is arranged some distance in front of the trigger, wherein the pivoting axis located on the lower end of the detent lever lies lower than the upper end of the trigger. Since the detent lever is acted upon by the rod above its pivoting axis, the pivoting motion of the actuated trigger about its axis leads to a pivoting motion of the detent lever in the same rotating direction as the trigger.

In this known trigger mechanism, the sear likewise tilts forward during the pivoting motion of the detent lever and therefore once again pivots in the same rotating direction as the detent lever.

What is needed, therefore, is an improved and constructively simplified trigger mechanism for a repeating rifle that also allows a simple adjustment of the trigger pull.

SUMMARY OF THE INVENTION

The present invention is a trigger mechanism for a repeating rifle that provides a simplified construction and also allows a simple adjustment of the trigger pull. The disclosed trigger mechanism comprises a sear that is pivotable about a first axis and a detent lever with a catch, which is assigned to said sear and pivotable about a second axis, as well as a trigger that is mounted so as to be pivotable about a trigger axis, wherein upon an actuation of the trigger the detent lever is acted upon by a force and carries out a pivoting motion about the second axis, and wherein the detent lever is acted upon by the trigger when the trigger is actuated, and wherein the catch of the detent lever, when in the cocked position, is engaged with a projection of the sear.

According to the invention, the detent lever is arranged above the trigger and includes an extension, which is arranged underneath its pivoting axis and directly acted upon by an edge of the trigger, without interposition of additional components.

According to embodiments of the invention, the pivoting motion of the trigger about the trigger axis, which is generated upon actuation of the trigger, acts upon the detent lever in such a way that this leads to a pivoting motion of the detent lever about its pivoting axis in the opposite rotating direction with respect to the pivoting motion of the trigger.

According to the present invention, therefore, the detent lever pivots in a rotating direction that is opposite to the rotating direction of the trigger, and the sear pivots in a rotating direction that is opposite to the rotating direction of the detent lever. This arrangement of the three components, namely the trigger, detent lever, and sear, is more compact then mechanisms of the prior art, because the detent lever is located directly above the trigger, rather than being spaced apart therefrom. Accordingly, when the trigger is actuated, the force prompting the detent lever to carry out a pivoting motion acts in a more direct manner. In addition, fewer springs are required than in prior art mechanisms, in part because the sear is mounted on the detent lever in such a way that a very short pivoting travel disengages the sear from its locked position and releases the firing pin.

In the present invention, the detent lever is directly acted upon by the trigger, and when in the cocked position the catch of the detent lever is engaged with a projection of the sear. In embodiments the disclosed trigger mechanism can be realized with only three interacting and respectively pivotable components, namely the sear that is pivotable about a first axis; the detent lever that is assigned to the sear, which pivots about a second axis and has a catch; and the trigger, which is mounted so as to be pivotable about the trigger axis and is actuated with the finger in order to fire a shot. In contrast, trigger mechanisms of the prior art typically comprise more than three interacting components, for example five such components.

The present invention pertains to a trigger mechanism for a repeating rifle which is particularly suitable for a straight-pull repeater. The detent edge of the trigger in such rifles must be hard, such that the trigger is typically made of steel, which with consideration of its geometry leads to a greater mass and a higher moment of inertia as compared to other trigger mechanisms. In fast repeaters (straight-pull repeaters), such constructions lead to accidentally fired shots, due to increased vibration of the trigger when the breech is abruptly closed. These vibrations of the detent lever are prevented according to the present invention due to the small mass of the detent lever and the use of a strong spring. This use of a strong adjusting spring is made possible, at least in part, by the lever ratios from the trigger up to the detent edge of the detent lever. The strong adjusting spring on the one hand prevents vibrations of the detent lever, and on the other hand allows precise adjustments of the trigger pull. Since the trigger has no detent edge, it can preferably be made of light metal or plastic, such that its moment of inertia is reduced.

In the present invention, the trigger directly acts upon the detent lever without interposition of an additional component. Instead, the upper region of the trigger presses upon its actuation, for example, against a projection on the underside of the detent lever, such that the detent lever typically carries out a pivoting motion about the aforementioned second axis in the opposite rotating direction compared to the pivoting motion of the trigger about the trigger axis. The pivoting travel of the detent lever can be comparatively short in this case, but suffices for disengaging the catch connection between the detent lever and the sear. In the present invention, the detent lever directly forms a catch connection with the sear in the cocked position, for example by means of a detent edge, such that this catch connection is disengaged during the above described pivoting motion of the detent lever and the sear is released, wherein the sear can subsequently carry out a pivoting motion that leads to the release of the cocking piece.

In the present invention, the catch connection is therefore produced between the detent lever and the sear, whereas the detent lever typically interacts in the prior art with a stationary counter-catch. This leads to a simplification in the present invention as compared to the prior art.

According to embodiments of the present invention, the counter-catch is located on the underside of the sear, wherein the projection provided therefor can be realized in the form of a downwardly protruding extension of the sear. The counter-catch is therefore formed by a pivotable component, namely by the sear itself.

A counter-catch in the form of a detent edge is formed in embodiments on an extension of the sear approximately in the lower end region, wherein this detent edge can interact with a catch on the upper side of the detent lever. If the detent lever is then pivoted about its axis, the catch connection with the sear is disengaged and the sear is released, wherein a relatively short pivoting travel of the detent lever can be sufficient.

The sear may have an elongate, approximately pin-like extension, for example on its underside, wherein said extension rests in the cocked position on the catch of the detent lever with a detent edge that is particularly located approximately in its lower end region.

The aforementioned extension with the detent edge may extend downward from the sear, for example approximately in the region of the first axis of the sear. In these embodiments, the detent edge is therefore located approximately underneath the axis of the sear.

In the above-described embodiments, the catch is consequently located on the upper side of the detent lever facing the sear, such that the pin-like extension, which extends downward from the sear, can interact with the catch on the upper side of the detent lever.

In the cocked state, the sear preferably rests on a lever arm of the detent lever, with the lower end of the extension, and produces a catch connection at this location. When the detent lever is pivoted about the second axis due to an actuation of the trigger, this catch connection is disengaged, because the lever arm of the detent lever is slightly lowered. The extension of the sear then slides over the detent edge and is thereby released, such that the sear can pivot about the first axis and tilt forward.

In order to adjust the trigger pull, embodiments of the invention provide an adjusting spring, which can be adjusted by means of an adjusting screw that is freely accessible from the underside of the trigger mechanism. In this way, the user of the weapon can use a tool in order to conveniently adjust the trigger pull in accordance with individual preferences. It is not required to disassemble the weapon so as to make this adjustment, nor is it necessary to have this adjustment carried out by an expert such as a gunsmith. The adjusting screw lies underneath the trigger housing, and in embodiments its axis lies in front of the trigger.

In embodiments, the adjusting spring that is used for adjustment of the trigger pull is accommodated in a bore on the underside of a stationary section of the trigger housing, and abuts therein with its end. In other embodiments, the adjusting screw can be accommodated, for example, in a bore of the detent lever. In this variation, the adjusting spring, which is acted upon by the adjusting screw, can extend through the bore in the detent lever so that it is mounted in the detent lever and ends in a bore of the trigger housing, which can be realized in the form of a blind bore. If the adjusting screw is screwed in further, the adjusting spring is compressed, and thereby increases its restoring force and the trigger pull.

According to embodiments of the invention, the sear can be acted upon on its underside by a return spring that is mounted in a bore of the stationary trigger housing, which moves the sear back into its horizontal starting position after a shot has been fired. According to various embodiments, an additional return spring can be provided which can be weaker than the adjusting spring for the trigger pull, wherein this additional return spring acts upon the trigger in an opposite rotating direction as compared to the adjusting spring, and thereby holds the trigger in a defined position without play.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
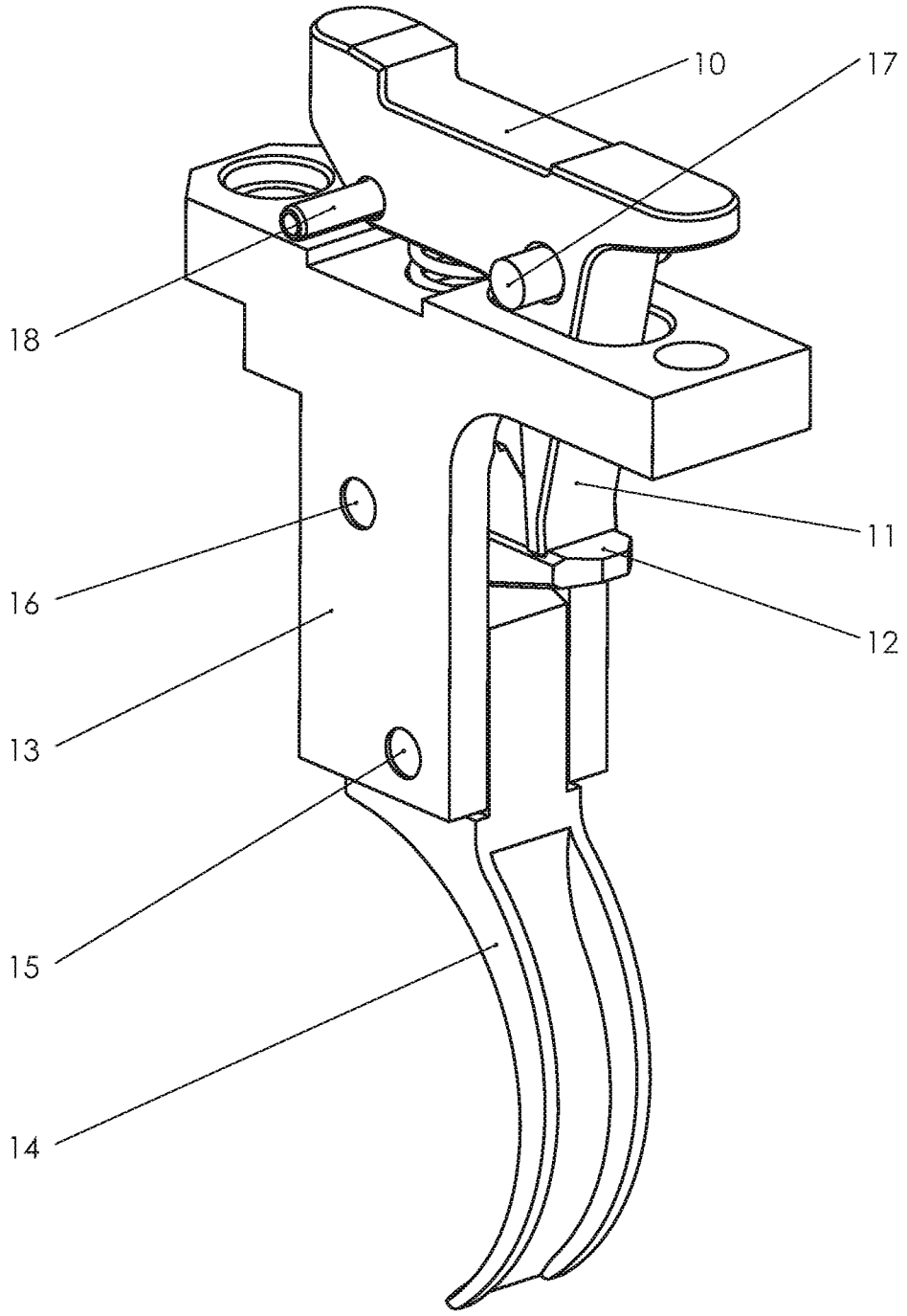
FIG. 1 is a schematically simplified, perspective view of an exemplary embodiment of the disclosed trigger mechanism for a repeating rifle, shown in the cocked and engaged state.

FIG. 1 is a simplified perspective view of a trigger mechanism that includes only components that are important for understanding the present invention, whereas the remaining components of the weapon as are included in various embodiments are not illustrated. In its upper region, the trigger mechanism comprises a sear 10 which, in the illustrated side view, has the approximate shape of a numeral seven, is located in a posterior region of the mechanism (as viewed in the firing direction), and is provided with a downwardly protruding extension 11. The extension 11 of the sear 10 rests on the detent lever 12, as can be even more clearly seen in FIG. 2. In FIG. 1, however, the detent lever 12 is largely obscured by stationary components 13 of the trigger mechanism. In its lower region, the stationary component 13 comprises a fork of sorts, in which the trigger 14 is mounted so as to be pivotable about the trigger axis 15. The detent lever 12 is likewise pivotably mounted in the fork of the stationary component 13 and pivots about the axis 16, which is referred to herein as the "second axis." The pivoting axis 17 of the sear 10 lies above the component 13 as illustrated in FIG. 1. In addition, a pin 18 is provided and extends through the sear 10 parallel to the pivoting axis 17, which is referred to herein as the "first axis."

The three most important interacting components of the trigger mechanism therefore are the sear 10 in the upper region, which is mounted so as to be pivotable about the first axis 17, the detent lever 12 positioned underneath the sear 10, which is mounted so as to be pivotable about the second axis 16, and the trigger 14 arranged in the lower region, which is mounted so as to be pivotable about the trigger axis 15. These three aforementioned components and their respective pivoting axes are illustrated particularly well in the sectional view according to FIG. 2, in which the trigger mechanism is shown in its cocked and engaged state. When the trigger 14 is actuated, it pivots about the trigger axis 15 in a counterclockwise direction as shown in the drawing, and thereby presses an edge 141 thereof against the lower extension 121 of the detent lever 12, which lies above the trigger axis 15, such that the detent lever is prompted to pivot about the second axis 16 in the clockwise direction.

Figure 2:
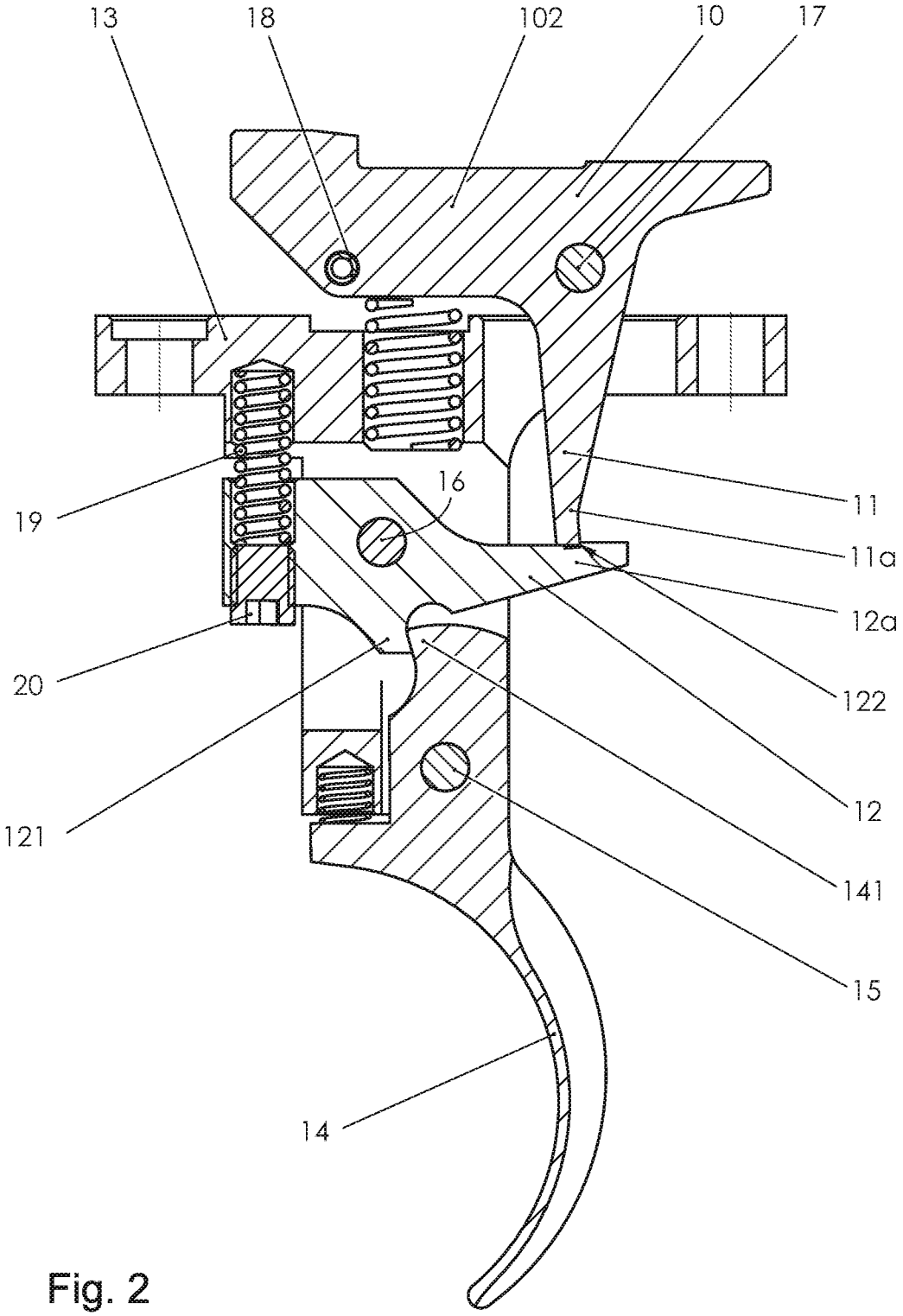
FIG. 2 is a sectional view of the embodiment of FIG. 1, shown in the cocked and engaged state.
Figure 3:
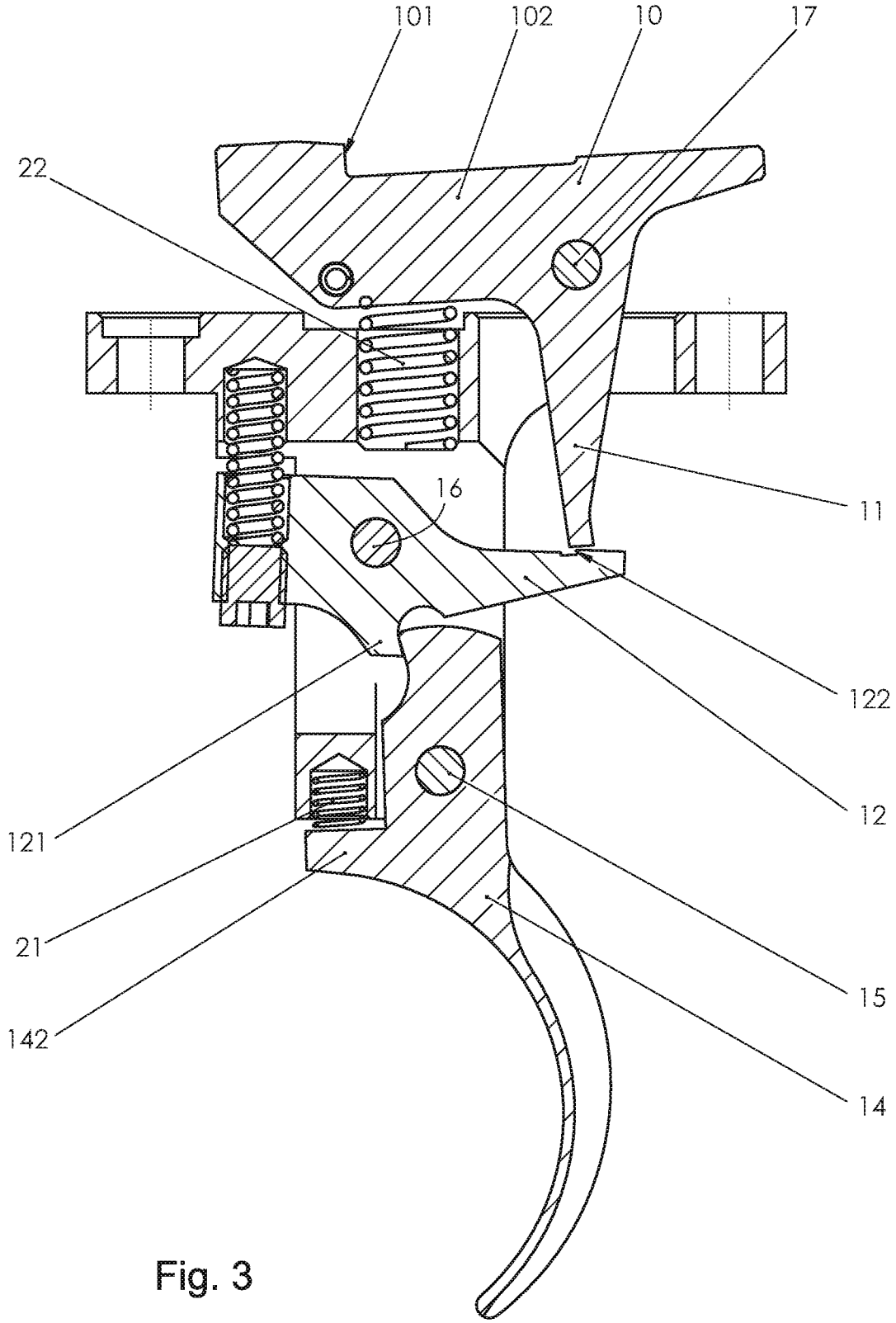
FIG. 3 is a sectional view of the embodiment of FIG. 2, shown in the disengaged state.

In its posterior region, the detent lever 12 has a catch 122 with a detent edge, on which the lower end of the extension 11 of the sear 10 rests in the cocked position according to FIG. 2. such that the sear 10 is held in position. When the detent lever 12 pivots about the second axis 16 in the clockwise direction due to an actuation of the trigger 14, the rear region 12*a* of the detent lever 12 is slightly moved downward. such that the catch connection disengages, as illustrated in FIG. 3. The rear lower edge 11*a* of the extension 11 of the sear 10 then moves over the detent edge 122 of the catch and the sear 10 pivots about the first axis 17 in the counterclockwise direction in the form of a forward and downward tilting motion, such that the cocking piece (not shown), which rests on the edge 101 of the sear 10, is released, and a shot is fired.

Consequently, the trigger 14 that pivots about its axis 15, the detent lever 12 that is engaged with this trigger by means of the lower extension 121, and the sear 10, the extension 11 of which is engaged with the catch of the detent lever 12, all interact during an actuation of the trigger 14, such that the kinematics of the trigger mechanism are essentially defined by these three pivotable components 10, 12, 14.

According to FIG. 2, the detent lever 12 is approximately centered above the trigger 14. The trigger 14 acts directly upon the detent lever 12 because the edge 141 on the upper end of the detent lever 14 rests directly on the rear edge of the lower extension 121 of the detent lever 12. When the trigger is actuated, the edge 141 presses against the edge of the lower extension 121, and the detent lever 12 pivots in the opposite rotating direction as compared to the trigger 14. The detent lever 12 is effectively realized in the form of a two-arm lever, wherein the adjusting screw 20 is arranged on one side of its pivoting axis 16 and an arm 12*a* extends toward the other side (in the drawing the rear side) of the detent lever, wherein the lower extension 11 of the sear 10 rests on said arm 12*a*, on which the detent edge 122 interacting with the extension 11 is also located. The catch connection between the detent edge 122 and the lower end 11*a* of the extension 11 is already disengaged upon a slight clockwise rotation of the detent lever when acted upon by the trigger 14, such that the sear 10 tilts forward and therefore pivots in the opposite direction as compared to the detent lever 12.

The extension 11 extends downward from the underside of the sear 10 approximately in alignment with the pivoting axis 17 of the sear 10, approximately at a right angle to the upper edge of the sear 10. The sear 10 therefore has the approximate shape of a capital letter T, wherein the vertically extending part of the T is formed by the extension 11, and wherein the extension 11 is comparatively long and extends downward from the pivoting axis 17 of the sear 10 to approximately the height of the pivoting axis 16 of the detent lever 12. However, the extension 11 is slightly shorter than the upper crosspiece of the T. Starting from the axis 17 and the upper end of the extension 11, this upper crosspiece of the T has two legs that extend toward both sides, wherein the horizontal leg 102, the underside of which rests on the sear return spring 22 (see FIG. 3), extends forward starting from the pivoting axis 17.

The force required for firing a shot, which has to be overcome by the user's finger during the actuation of the trigger 14 (pressure point), is defined as the "trigger pull," wherein this trigger pull can be variably adjusted in accordance with the requirements of the user by means of the adjusting spring 19 illustrated in FIGS. 2 and 3. This adjustment is realized by means of the adjusting screw 20, the particular advantage of which can be seen in that it is freely accessible from below, as illustrated in FIG. 2 such that the adjusting screw can be actuated, for example, using a screwdriver, and without requiring the disassembly of any part of the weapon. The axis of this adjusting screw 20, and of the adjusting spring 19, respectively, extend in the vertical direction (when the weapon is oriented horizontally), such that the axis of the adjusting screw extends in front of the trigger 14. It is therefore possible to conveniently reach the adjusting screw 20 with a tool while the trigger mechanism is completely installed as illustrated in FIG. 2.

In embodiments, the adjusting spring 19 is a comparatively strong spring that extends through a bore in the detent lever 12, wherein this bore extends transverse to the second pivoting axis 16 of the detent lever 12. This bore is open toward the top, and the adjusting spring 19 continues to extend into a blind bore in the trigger housing 13, in which it abuts with its end. The adjusting screw 20 presses against the adjusting spring 19 with its front end, which faces away from the screw head. If the adjusting screw 20 is screwed in further, the adjusting spring 19 is compressed and causes the trigger pull to increase, because the force of the adjusting spring 19 (which is a pressure spring) must be overcome in order to actuate the trigger 14.

It can be seen in FIG. 3 that the trigger mechanism in the illustrated embodiment comprises two additional springs. The first additional spring is the trigger return spring 21, which rests on a front upper shoulder 142 of the trigger 14, and ensures that the trigger is always in position and has no play. It may therefore consist of a comparatively weak spring.

In addition, a sear return spring 22 is provided, which is located underneath the underside of the sear 10. In a longitudinal section, the sear 10 has the approximate shape of a numeral seven, and comprises an upper leg 102, which approximately extends horizontally when the mechanism is in its cocked position, as illustrated in FIG. 2, and a vertical leg, which approximately extends perpendicular to the horizontal leg 102 in the region of the pivoting axis 17, and corresponds to the extension 11. Starting from the pivoting axis 17, this extension 11 is gradually tapered downward, and rests on, the detent lever 12 with its lower end, as described above. In the engaged position illustrated in FIG. 2, the horizontal leg 102 is in balance, and rests with its underside on the sear return spring 22. The disengaged state is illustrated in FIG. 3, which shows the horizontal leg 102 of the sear 10, which is slightly tilted forward, wherein the sear 10 is then once again moved back into its horizontal position by the sear return spring 22.

LIST OF ITEM NUMBERS USED IN THE DRAWINGS

10 Sear
11 Extension, projection of sear
12 Detent lever
13 Trigger housing, stationary component
14 Trigger
15 Trigger axis
16 Second axis, pivoting axis of detent lever
17 First axis, pivoting axis of sear
18 Pin
19 Adjusting spring
20 Adjusting screw
21 Trigger return spring
22 Sear return spring
101 Edge
102 Horizontal leg
121 Lower extension
122 Detent edge
141 Edge
142 Upper shoulder of trigger The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

I claim:

1. A trigger mechanism for a repeating rifle, said trigger mechanism being configured for transitioning between an engaged configuration and a disengaged configuration, the trigger mechanism comprising:

a trigger housing;

a sear located at least partly within the trigger housing and pivotable about a first axis, said sear including a sear projection extending into the housing;

a detent lever located at least partly within the trigger housing and pivotable about a second axis and having a catch that is configured for engagement with the sear projection when the trigger mechanism is in the engaged configuration, the detent lever including a detent extension located below the second axis;

a trigger lever mounted below the detent lever and located at least partly within the trigger housing, the trigger lever being pivotable about a trigger axis, the trigger lever begin configured such that, when the trigger lever is actuated, an edge of the trigger lever acts upon the detent extension, without interposition of any additional components therebetween, so as to cause the detent lever to carry out a pivoting motion about the second axis, thereby releasing the sear projection from engagement with the catch; and an adjusting spring configured to adjust a trigger pull of the trigger mechanism, wherein the adjusting spring can be adjusted by means of an adjusting screw that is freely accessible from the underside of the trigger mechanism, an axis of the adjusting screw being arranged in front of the trigger lever as viewed in the firing direction.

2. The trigger mechanism according to claim 1, wherein actuating the trigger lever includes inducing a pivoting motion of the trigger lever about the trigger axis that is opposite in rotational direction to the pivoting motion of the detent lever about the second axis that is caused by the actuation of the trigger.

3. The trigger mechanism according to claim 1, wherein the sear projection is realized in the form of a downwardly protruding extension of the sear.

4. The trigger mechanism according to claim 3, wherein a counter-catch in the form of a detent edge is located in a lower end region of the sear extension.

5. The trigger mechanism according to claim 3, wherein the sear extension has an elongate and approximately pin-like shape.

6. The trigger mechanism according to claim 3, wherein the sear extension extends downward from the sear approximately in the region of the first axis.

7. The trigger mechanism according to claim 1, characterized in that the catch is located on an upper side of the detent lever facing the sear.

8. The trigger mechanism according to claim 1, wherein the adjusting spring is accommodated in a bore on an underside of a stationary section of the trigger housing and abuts therein with its end.

9. The trigger mechanism according to claim 1, wherein the adjusting screw is accommodated in a bore of the detent lever.

10. The trigger mechanism of claim 1, wherein the adjusting spring is accommodated over part of its length in a bore of the detent lever.

11. The trigger mechanism of claim 1, further comprising a return spring configured to act upon the trigger lever in rotational opposition to the adjusting spring so as to hold the trigger in a defined position without play.

12. The trigger mechanism of claim 1, wherein the trigger return spring is weaker than the adjusting spring.

13. The trigger mechanism of claim 1, characterized in that the sear is acted upon on its underside by a sear return spring that is mounted in a bore of the trigger housing.

14. A repeating rifle, comprising a trigger mechanism according to claim 1.

* * * * *